US007945195B2

(12) United States Patent
Inoue et al.

(10) Patent No.: US 7,945,195 B2
(45) Date of Patent: May 17, 2011

(54) DEVELOPING DEVICE HAVING DEVELOPER REGULATING MEMBER, AND IMAGE FORMING APPARATUS USING DEVELOPING DEVICE

(75) Inventors: Ryuji Inoue, Hyogo (JP); Shuuichi Nakagawa, Osaka (JP); Shin Murayama, Hyogo (JP); Rumi Konishi, Osaka (JP); Shintaro Yamada, Toyko (JP); Kazushige Oonishi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 305 days.

(21) Appl. No.: 11/947,369

(22) Filed: Nov. 29, 2007

(65) Prior Publication Data

US 2008/0131174 A1 Jun. 5, 2008

(30) Foreign Application Priority Data

Dec. 1, 2006 (JP) ..... 2006-325574

(51) Int. Cl.
*G03G 15/08* (2006.01)

(52) U.S. Cl. ..... 399/284

(58) Field of Classification Search ..... 399/284
See application file for complete search history.

(56) References Cited

U.S. PATENT DOCUMENTS 5,587,551 A * 12/1996 Ikegawa et al. ..... 399/284
5,867,755 A * 2/1999 Sato ..... 399/149
2005/0214032 A1* 9/2005 Koyanagi et al. ..... 399/279
2006/0045576 A1* 3/2006 Oshika ..... 399/284
2006/0280529 A1 12/2006 Nakagawa et al.
2007/0104523 A1 5/2007 Yoshida et al.
2007/0189812 A1 8/2007 Murayama et al.

FOREIGN PATENT DOCUMENTS

JP 5-117813 5/1993
JP 2001-92248 4/2001
JP 2003-193202 7/2003

OTHER PUBLICATIONS

U.S. Appl. No. 12/179,038, filed Jul. 24, 2008, Murayama et al.

* cited by examiner

*Primary Examiner* — David M Gray
*Assistant Examiner* — Ruth N Labombard
(74) *Attorney, Agent, or Firm* — Oblon, Spivak, McClelland, Maier & Neustadt, L.L.P.

(57) ABSTRACT

A developer regulating member capable of stably regulating the thickness of a developer even when used for a long time, while preventing the increase in the production cost, a developing device having the developer regulating member, an image forming apparatus having the developing device, a process cartridge, and a method of producing the developer regulating member. The average crystal particle diameter D [μm] of a plate-like member provided in a layer-thinning blade which functions as the developer regulating member and which abuts against a developing roller functioning as a developer carrier, and the curvature radius R [μm] of a bent portion satisfy the relationship of $D \leqq 60.53 \times R \times 10^{-3} - 12.61$.

8 Claims, 12 Drawing Sheets

| MATERIAL NAME | METALLIC AVERAGE PARTICLE DIAMETER D [μm] |
|---|---|
| SUS301 | 32 |
| SUS304 | 22 |
| NAR301 | 2 |

FIG. 5

| | MATERIAL NAME | METALLIC AVERAGE PARTICLE DIAMETER D [μm] | CURVATURE RADIUS R [μm] | TEN-POINT AVERAGE ROUGHNESS Rz [μm] |
|---|---|---|---|---|
| EXPERIMENTAL EXAMPLE 1 | NAR301 | 2 | 200 | 1.66 |
| EXPERIMENTAL EXAMPLE 2 | NAR301 | 2 | 300 | 1.50 |
| EXPERIMENTAL EXAMPLE 3 | NAR301 | 2 | 400 | 0.87 |
| EXPERIMENTAL EXAMPLE 4 | NAR301 | 2 | 500 | 0.73 |
| EXPERIMENTAL EXAMPLE 5 | NAR301 | 2 | 600 | 0.61 |
| EXPERIMENTAL EXAMPLE 6 | SUS304-CSP-H | 22 | 400 | 2.50 |
| EXPERIMENTAL EXAMPLE 7 | SUS304-CSP-H | 22 | 500 | 1.55 |
| EXPERIMENTAL EXAMPLE 8 | SUS304-CSP-H | 22 | 600 | 1.44 |
| EXPERIMENTAL EXAMPLE 9 | SUS304-CSP-H | 22 | 700 | 1.20 |
| EXPERIMENTAL EXAMPLE 10 | SUS301-CSP-H | 32 | 400 | 2.88 |
| EXPERIMENTAL EXAMPLE 11 | SUS301-CSP-H | 32 | 500 | 2.62 |
| EXPERIMENTAL EXAMPLE 12 | SUS301-CSP-H | 32 | 600 | 2.04 |
| EXPERIMENTAL EXAMPLE 13 | SUS301-CSP-H | 32 | 700 | 1.78 |
| EXPERIMENTAL EXAMPLE 14 | SUS301-CSP-H | 32 | 800 | 1.48 |
| EXPERIMENTAL EXAMPLE 15 | NAR301 | 2 | FLAT PLATE | 0.24 |
| EXPERIMENTAL EXAMPLE 16 | SUS304-CSP-H | 22 | FLAT PLATE | 0.60 |
| EXPERIMENTAL EXAMPLE 17 | SUS301-CSP-H | 32 | FLAT PLATE | 0.72 |

FIG. 10

| | METALLIC AVERAGE PARTICLE DIAMETER D [μm] | CURVATURE RADIUS R [μm] | TEN-POINT AVERAGE ROUGHNESS Rz [μm] | BLADE FIXATION PROPERTY | TONER AMOUNT STABILITY | COMPREHENSIVE EVALUATION |
|---|---|---|---|---|---|---|
| EXPERIMENTAL EXAMPLE 1 | 2 | 200 | 1.66 | × | × | × |
| EXPERIMENTAL EXAMPLE 2 | 2 | 300 | 1.50 | ○ | ○ | ○ |
| EXPERIMENTAL EXAMPLE 3 | 2 | 400 | 0.87 | ○ | ○ | ○ |
| EXPERIMENTAL EXAMPLE 4 | 2 | 500 | 0.73 | ○ | ○ | ○ |
| EXPERIMENTAL EXAMPLE 5 | 2 | 600 | 0.61 | ○ | △ | ○ |
| EXPERIMENTAL EXAMPLE 6 | 22 | 400 | 2.50 | × | ○ | × |
| EXPERIMENTAL EXAMPLE 7 | 22 | 500 | 1.55 | × | ○ | × |
| EXPERIMENTAL EXAMPLE 8 | 22 | 600 | 1.44 | ○ | ○ | ○ |
| EXPERIMENTAL EXAMPLE 9 | 22 | 700 | 1.20 | ○ | △ | ○ |
| EXPERIMENTAL EXAMPLE 10 | 32 | 400 | 2.88 | × | ○ | × |
| EXPERIMENTAL EXAMPLE 11 | 32 | 500 | 2.62 | × | ○ | × |
| EXPERIMENTAL EXAMPLE 12 | 32 | 600 | 2.04 | × | ○ | × |
| EXPERIMENTAL EXAMPLE 13 | 32 | 700 | 1.78 | × | △ | × |
| EXPERIMENTAL EXAMPLE 14 | 32 | 800 | 1.48 | ○ | △ | ○ |

FIG. 13

| | MATERIAL NAME | METALLIC AVERAGE PARTICLE DIAMETER D [μm] | CURVATURE RADIUS R [μm] | TEN-POINT AVERAGE ROUGHNESS Rz [μm] |
|---|---|---|---|---|
| EXPERIMENTAL EXAMPLE 2 | NAR301 | 2 | 300 | 1.50 |
| EXPERIMENTAL EXAMPLE 8 | SUS304-CSP-H | 22 | 600 | 1.44 |
| EXPERIMENTAL EXAMPLE 18 | NAR301 | 2 | 300 | 1.76 |
| EXPERIMENTAL EXAMPLE 19 | SUS304-CSP-H | 22 | 600 | 1.99 |
| EXPERIMENTAL EXAMPLE 20 | NAR301 | 2 | 500 | 1.12 |
| EXPERIMENTAL EXAMPLE 21 | NAR301 | 2 | 500 | 2.01 |
| EXPERIMENTAL EXAMPLE 22 | NAR301 | 2 | 1000 | 0.48 |
| EXPERIMENTAL EXAMPLE 23 | NAR301 | 2 | 500 | 1.51 |
| EXPERIMENTAL EXAMPLE 24 | NAR301 | 2 | 500 | 0.67 |
| EXPERIMENTAL EXAMPLE 25 | NAR301 | 2 | 500 | 0.58 |
| EXPERIMENTAL EXAMPLE 26 | NAR301 | 2 | 500 | 0.53 |

FIG. 14

| | METALLIC AVERAGE PARTICLE DIAMETER D [μm] | CURVATURE RADIUS R [μm] | TEN-POINT AVERAGE ROUGHNESS Rz [μm] | BLADE FIXATION PROPERTY | TONER AMOUNT STABILITY | COMPREHENSIVE EVALUATION |
|---|---|---|---|---|---|---|
| EXPERIMENTAL EXAMPLE 2 | 2 | 300 | 1.50 | ○ | ○ | ○ |
| EXPERIMENTAL EXAMPLE 8 | 22 | 600 | 1.44 | ○ | ○ | ○ |
| EXPERIMENTAL EXAMPLE 18 | 2 | 300 | 1.76 | × | ○ | × |
| EXPERIMENTAL EXAMPLE 19 | 22 | 600 | 1.99 | × | △ | × |
| EXPERIMENTAL EXAMPLE 20 | 2 | 500 | 1.12 | ○ | ○ | ○ |
| EXPERIMENTAL EXAMPLE 21 | 2 | 500 | 2.01 | × | ○ | × |
| EXPERIMENTAL EXAMPLE 22 | 2 | 1000 | 0.48 | ○ | × | × |
| EXPERIMENTAL EXAMPLE 23 | 2 | 500 | 1.51 | × | ○ | × |
| EXPERIMENTAL EXAMPLE 24 | 2 | 500 | 0.67 | ○ | ○ | ○ |
| EXPERIMENTAL EXAMPLE 25 | 2 | 500 | 0.58 | ○ | ○ | ○ |
| EXPERIMENTAL EXAMPLE 26 | 2 | 500 | 0.53 | ○ | × | × |

FIG. 17

| | MD-1 HARDNESS [°] | ARITHMETIC AVERAGE ROUGHNESS Ra [μm] | BLADE FIXATION PROPERTY | TONER AMOUNT STABILITY | COMPREHENSIVE EVALUATION |
|---|---|---|---|---|---|
| EXPERIMENTAL EXAMPLE 27 | 32 | 0.67 | × | ○ | × |
| EXPERIMENTAL EXAMPLE 28 | 32 | 0.85 | ○ | ○ | ○ |
| EXPERIMENTAL EXAMPLE 29 | 32 | 1.15 | ○ | ○ | ○ |
| EXPERIMENTAL EXAMPLE 30 | 32 | 1.60 | ○ | ○ | ○ |
| EXPERIMENTAL EXAMPLE 31 | 32 | 1.80 | ○ | × | × |
| EXPERIMENTAL EXAMPLE 32 | 55 | 0.65 | × | ○ | × |
| EXPERIMENTAL EXAMPLE 33 | 55 | 0.80 | ○ | ○ | ○ |
| EXPERIMENTAL EXAMPLE 34 | 55 | 1.20 | ○ | ○ | ○ |
| EXPERIMENTAL EXAMPLE 35 | 55 | 1.60 | ○ | ○ | ○ |
| EXPERIMENTAL EXAMPLE 36 | 55 | 1.80 | ○ | × | × |

DEVELOPING DEVICE HAVING DEVELOPER REGULATING MEMBER, AND IMAGE FORMING APPARATUS USING DEVELOPING DEVICE

BACKGROUND OF THE INVENTION

1. Field of the Invention

The present invention relates to a developer regulating member that regulates the thickness of a developer on the surface of a developer carrier provided in an image forming apparatus such as a copying machine, a printer, and a facsimile machine, a developing device having this developer regulating member, a process cartridge, and an image forming apparatus. In addition, the present invention relates to a method for manufacturing the developer regulating member.

2. Description of the Related Art

As a developer regulating member for regulating the thickness of a developer formed on the surface of a developing roller functioning as a developer carrier provided in a developing device of an image forming apparatus, there has conventionally been known a blade-like developer regulating member using a plate-like member.

For example, Japanese Unexamined Patent Application Laid-open No. 2001-92248 describes the configuration in which a layer-thinning blade, which a blade-like developer regulating member for thinning a developer, is caused to abut on the surface of a developer carrier. This layer-thinning blade has a bent portion in which a metallic plate-like member is bent at a predetermined curvature, wherein a surface of the bent portion is caused to abut on a developing roller so that an edge line of the bent portion intersects at right angles with a direction of surface movement of the developing roller. By causing the bent portion to abut on the surface of the developing roller, the abutment pressure on the abutting portion rarely fluctuates and the thickness of the developer passing through the abutting portion can be stabilized, compared to so-called edge abutment for causing a tip end of the plate-like member to abut on the developing roller.

Moreover, according to this publication, the range of the curvature radius of the bent portion of the plate-like member is limited, whereby fixation of the developer that is caused by an excess load imposed on the developer passing through the abutting portion is prevented from occurring, and at the same time a uniform thin layer of the developer can be formed by an appropriate developer regulating force.

However, even if the curvature radius of the bent portion of the plate-like member has not been changed, stripe-like image noise has sometimes occurred depending on the material of the plate-like member due to long-term use. The stripe-like image noise occurs due to the following reason.

Specifically, the outer peripheral surface of the bent portion is stretched by ending the metallic plate-like member, causing surface roughening, i.e., cracking, on this surface. When the surface formed with such cracks is caused to abut on the developing roller to regulate the thickness of the developer passing through the abutting portion, the flow of the developer is inhibited by these cracks, and then the developer is stuck and adhered to the section of the layer-thinning blade in which cracks are generated. The developer adhering to the cracks of the layer-thinning blade adheres to the layer-thinning blade as time advances. The developer adhering to the layer-thinning blade obstructs the passage of the developer passing through the abutting portion from behind the layer-thinning blade, thus fluctuation occurs in the amount of developer passing through the abutting portion regulating the thickness of the developer. Specifically, the amount of developer passing through the section of the layer-thinning blade where the developer adheres is reduced. For this reason, stripe-like image noise is generated in an image corresponding to the developing roller surface that faces the section of the layer-thinning blade to which the developer adheres. Even if the curvature radius of the bent portion has not been changed, the state in which cracks occur due to the image noise varies according to the material of the plate-like member.

In order to remove the cracks of the bent portion, there are methods for performing buffing or other mechanical polishing, chemical polishing, electrolytic polishing and the like to obtain a smooth surface, but the problem is that any of the methods require facilities and processing time, which results in a significant increase in the production cost.

SUMMARY OF THE INVENTION

The present invention was contrived in view of the above problems, thus it is an object of the present invention to provide a developer regulating member capable of stably regulating the thickness of a developer even when used for a long time, while preventing the increase in the production cost, a developing device having the developer regulating member, an image forming apparatus having the developing device, a process cartridge, and a method of producing the developer regulating member.

In an aspect of the present invention, a developer regulating member comprises a plate-like member made of an elastic metallic material and having a bent portion bent at a predetermined curvature radius and causes a surface of the bent portion to abut against a surface of a developer carrier so that an edge line of the bent portion intersects at right angles with a direction of surface movement of the developer carrier, to thereby regulate the thickness of a developer on the developer carrier. When the curvature radius is represented as R [μm] and an average crystal particle diameter of the plate-like member is represented as D [μm], the curvature radius R and the average crystal particle diameter D satisfy the following expression (1):

$$D \leqq 60.53 \times R \times 10^{-3} - 12.61 \quad \text{Eq. (1).}$$

In another aspect of the present invention, a developing device comprises a developer carrier that supports and transports one-component developer and a developer regulating member that regulates the developer on the developer carrier. The developer regulating member comprises a plate-like member made of an elastic metallic material and having a bent portion bent at a predetermined curvature radius, and causes a surface of the bent portion to abut against a surface of a developer carrier so that an edge line of the bent portion intersects at right angles with a direction of surface movement of the developer carrier, to thereby regulate the thickness of a developer on the developer carrier, and when the curvature radius is represented as R [μm] and an average crystal particle diameter of the plate-like member is represented as D [μm], the curvature radius R and the average crystal particle diameter D satisfy the following expression (1):

$$D \leqq 60.53 \times R \times 10^{-3} - 12.61 \quad \text{Eq. (1).}$$

In another aspect of the present invention, an image forming apparatus comprises a latent image carrier and a developing device for developing a latent image formed on the latent image carrier by using a developer. The developing device has a developer carrier that supports and transports one-component developer; and a developer regulating member that regulates the developer on the developer carrier. The developer regulating member comprises a plate-like member made of an elastic metallic material and having a bent portion bent at a predetermined curvature radius and causes a surface of the bent portion to abut against a surface of a developer carrier so that an edge line of the bent portion intersects at right angles with a direction of surface movement of the developer carrier, to thereby regulate the thickness of a developer on the developer carrier, and when the curvature radius is represented as R [μm] and an average crystal particle diameter of the plate-like member is represented as D [μm], the curvature radius R and the average crystal particle diameter D satisfy the following expression (1):

$$D \leqq 60.53 \times R \times 10^{-3} - 12.61 \quad \text{Eq. (1).}$$

BRIEF DESCRIPTION OF THE DRAWINGS

The above and other objects, features and advantages of the present invention will become more apparent from the following detailed description taken with the accompanying drawings in which:

FIG. 5 is a view showing the results of measurement performed in Experimental examples 1 through 17 in which the metallic materials used in Experiment 1 and curvature radius R [μm] of a bent portion are changed;

FIG. 10 is a view showing the experimental results of Experiment examples 1 through 14 of Experiment 1;

FIG. 13 is a view showing Experimental examples 18 through 26 corresponding to FIG. 5 of Experiment 1 in Experiment 2 of the present embodiment;

FIG. 14 is a view showing the experimental results of the Experimental examples 18 through 26 of Experiment 2;

FIG. 17 is a view showing the experimental results of Experiment 5 of the present embodiment.

DESCRIPTION OF THE PREFERRED EMBODIMENTS

First, the inventors of the present invention have discovered through keen studies that the occurrence of cracks is suppressed when a material having small average crystal particle diameter is used on the bent portion. As a result of the experiment, in the developer regulating member of the present invention, it was found that the developer has adhered to the developer regulating member even when used for a long time, as long the relationship of $D60.53 \times R \times 10^{-3} - 12.61$ is satisfied by the average crystal particle diameter D [μm] and the curvature radius R [μm]. Also, according to this configuration, the relationship between the average crystal particle diameter and the curvature radius is set so that the developer is prevented form being fixed to the developer regulating member by cracks, thus a step of removing the cracks formed in the bent portion when producing the developer restricting member is not required.

Hereinafter, an embodiment of an electrophotographic printer (simply called "printer 100" hereinafter) is described in detail as an image forming apparatus to which the present invention is applied.

Figure 1:
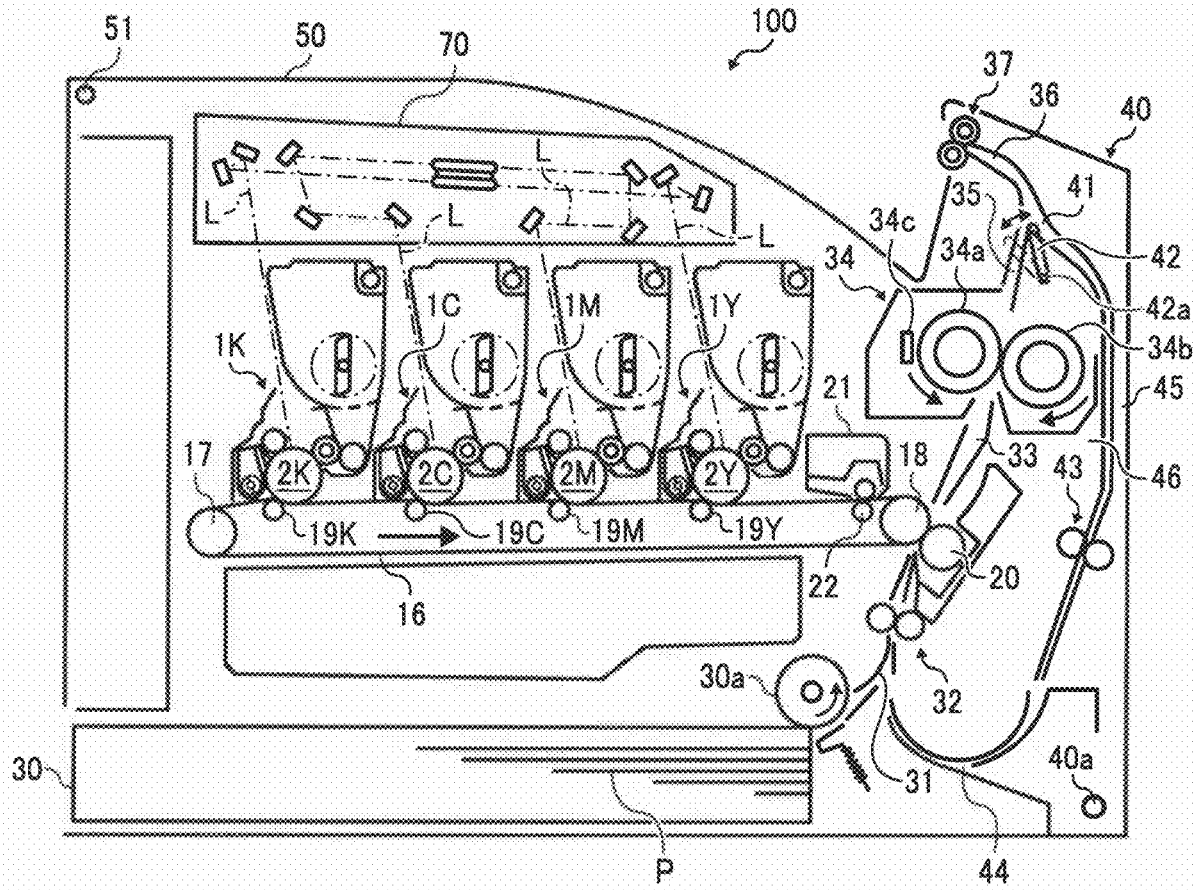
FIG. 1 is a view showing a schematic configuration of a printer of a present embodiment.

First, the basic configuration of the printer 100 is described. FIG. 1 shows a schematic configuration of the printer 100. As shown in the figure, the printer 100 has process units 1Y, M, C, K as four process cartridges for forming yellow, magenta, cyan, black (denoted as Y, M, C, K hereinafter) toner images. They use Y, M, C, K toners of different colors as the developers but have the same structure except for the colors and are replaced when the life time thereof expire. Since the four process units 1Y, M, C, K have the same structure, in FIG. 3 the alphabets "Y," "M," "C" and "K" are omitted to explain the process unit 1.

Figure 2:
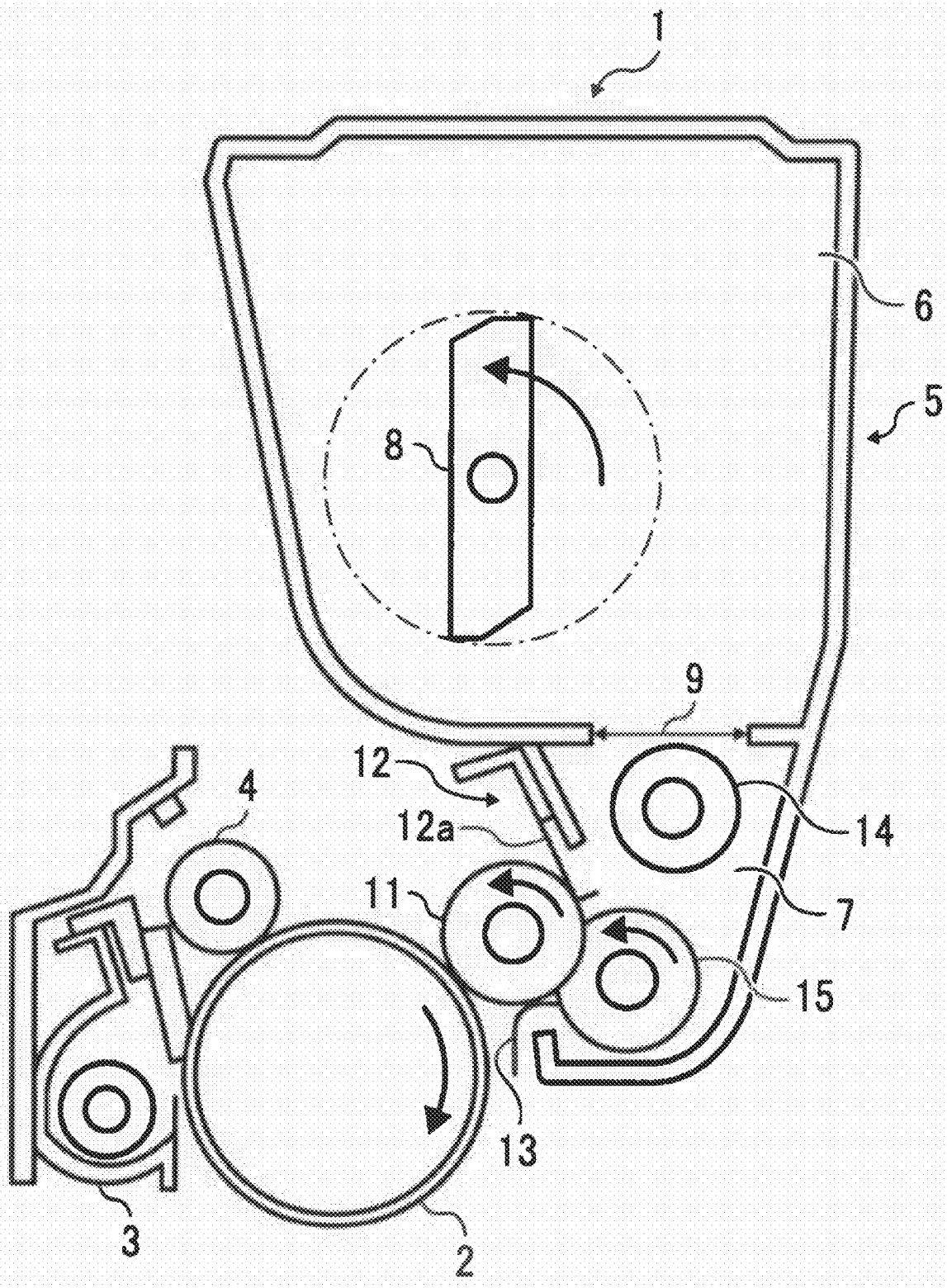
FIG. 2 is a view showing a schematic configuration of a developing device provided in the printer.

FIG. 2 shows a schematic configuration of the process unit 1. The process unit 1 has a drum-like photoreceptor 2 which is a latent image carrier, a photoreceptor cleaning device 3, a destaticizing device (not shown), a charging roller 4, a developing device 5 and the like. The process unit 1 is detachable with respect to the printer 100 main body and is designed such that wear-out parts can be replaced at once by unlocking the stopper that prevents the wear-out parts from unexpectedly falling from the printer 100.

The photoreceptor 2 is driven to rotate in a clockwise direction as shown in the drawing at a linear velocity of 150 [mm/sec] by driving means which is described hereinafter. The charging roller 4 is pressed against the surface of the photoreceptor 2 and driven to rotate by the rotation of the photoreceptor 2. Also, the charging roller 4 is applied with high voltage by a high-voltage power circuit, not shown, to charge the surface of the photoreceptor 2 to −500 [V].

An optical writing unit 70, which is exposing means, exposes image information onto the photoreceptor 2 to form an electrostatic latent image. A laser-beam scan using a laser diode, LED and the like are used as the optical writing unit 70.

The developing device 5 is for one-component contact development, and a developing roller 11 of the developing device 5, which is a developer carrier, is supplied with a predetermined developing bias from a high-voltage power source, not shown, thereupon the electrostatic latent image formed on the photoreceptor 2 is visualized as a toner image. Then, the toner image is intermediately transferred to an intermediate transfer belt 16 which is described hereinafter. The photoreceptor cleaning device 3 slides a cleaning brush or a cleaning blade on the surface of the photoreceptor 2 to thereby remove residual toner after transfer which adheres to the surface of the photoreceptor 2 after an intermediate transfer process.

The destaticizing device, not shown, destaticizes residual charges on the photoreceptor 2 after cleaning. By this destaticization, the surface of the photoreceptor 2 is initialized to prepare for the next image formation.

The four process units 1 are disposed in parallel with a surface movement direction of the intermediate transfer belt 16 to form yellow, cyan, magenta and black visible images in this order. A primary transfer roller 19 is applied with a primary transfer bias, and toner image on the surface of the photoreceptor 2 is transferred to the surface of the intermediate transfer belt 16. The intermediate transfer belt 16 is endlessly moved by a drive motor, not shown, in the direction of the arrow shown in FIG. 2, whereby the visible images of the respective colors are sequentially transferred to the surface thereof and superimposed on one another to form a full-color image.

The full-color image formed on the intermediate transfer belt 16 reaches a secondary transfer nip, which is a section where a secondary transfer roller 20 and a secondary transfer section facing roller 18 face each other. Then, a predetermined voltage is applied to the secondary transfer roller 20, whereby the full-color image is transferred to a paper P which is a recording body. The paper P to which the image is transferred is transported to a fixing device 34 where the full-color image is then fixed onto the surface of the paper, and then stacked on a stack portion, which is an upper surface of an upper cover 50 of the casing.

The toner that remains on the intermediate transfer belt 16 without being transferred to the paper P at the secondary transfer nip is recovered by a transfer belt cleaning device 21.

The developing device 5 has a vertically long toner storage chamber 6 for storing toner which is unshown nonmagnetic one-component developer, and a toner supply chamber 7 provided below the toner storage chamber 6. At the lower section of the toner supply chamber 7, the developing roller 11 as the developer carrier and a layer-thinning blade 12 abutting on the developing roller 11 as the developer regulating member are provided. Furthermore, a supply roller 15 abutting on the developing roller 11 and supplying the developer to the developing roller 11 is provided. The developing roller 11 is disposed in contact with the photoreceptor 2 and applied with a predetermined developing bias from the high-voltage power source which is not shown.

Figures 3, 4:
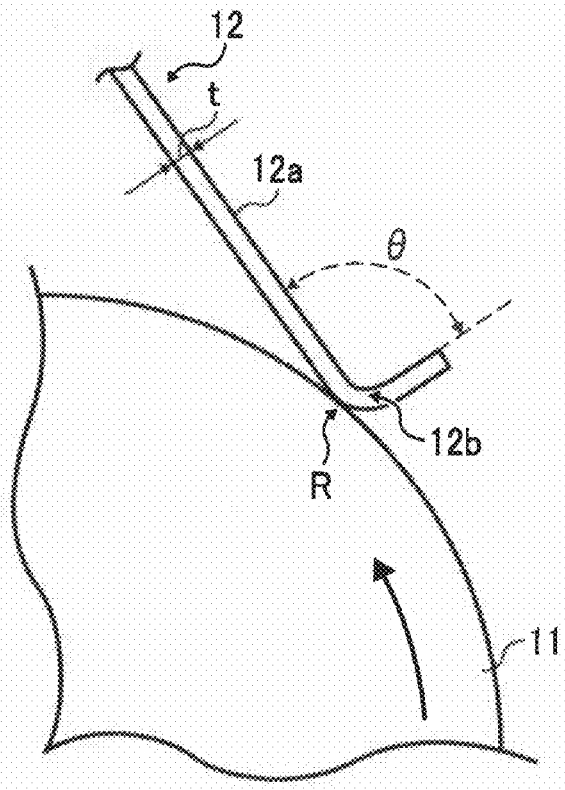
FIG. 3 is a view for explaining a layer-thinning blade applied to the present embodiment.
FIG. 4 is a view showing an average particle diameter of a metallic crystal that is formed on a cut surface of a plate-like member composed of metallic materials used in Experiment 1 of the present embodiment.

The inside of the toner storage chamber 6 is provided with a toner stirring member 8 which rotates in the counterclockwise direction to thereby allow the stored toner to flow and fall onto the toner supply chamber 7 through an opening portion 9. Moreover, as shown in FIG. 3, the opening portion 9 is provided, and a partition wall between the toner storage chamber 6 and the toner supply chamber 7, and a toner guiding member 14 for guiding the toner passing through the opening portion 9 are provided above the supply roller 15. The closest distance between the toner guiding member 14 and the supply roller 15 is preferably larger than 0 [mm] but smaller than 5 [mm].

The surface of the supply roller 15 is coated with a foamed material having holes (cells) so as to efficiently adhere and extract the toner sent into the toner supply chamber 7 and to prevent toner deterioration caused excessive pressure applied to the abutment portion between the supply roller 15 and the developing roller 11. It should be noted that the electric resistance value of the foamed material of the supply roller 15 is set to $10^3$ through $10^{14}$ [Ω].

A supply bias that is offset in the same direction as that of the electrified polarity of the toner with respect to the developing bias is applied to the supply roller 15. This supply bias acts in a direction for pressing the toner, which is previously charged at the abutment portion between the supply roller 15 and the developing roller 11, against the developing roller 11.

However, the offset direction is not limited to the above-mentioned direction, thus the offset may be set to 0 or the offset direction may be changed in accordance with the type of the toner.

The supply roller 15 rotates in the counterclockwise direction to supply and apply the toner adhering to the surface thereof onto the surface of the developing roller 11. A roller coated with an elastic rubber layer is used as the developing roller 11, and the surface thereof is provided with a surface coating layer that is made of a material charged easily to a polarity opposite to that of the toner. The hardness of the elastic rubber layer is set to MD-1 hardness of 60 [°] or less in order to maintain the contact state between the elastic rubber layer and the photoreceptor 2 evenly, and the electric resistance value of the elastic rubber layer is set to $10^3$ through $10^{10}$ [Ω] in order to activate the developing bias. The surface roughness of the elastic rubber layer is set to Ra of 0.2 through 2.0 [μm] so that required amount of toner is held on the surface. The developing roller 11 rotates in the counterclockwise direction to transport the toner held on the surface thereof to the position where the developing roller 11 and the layer-thinning blade 12 face each other, and further to the position where the developing roller 11 and the photoreceptor 2 face each other.

There has conventionally been a so-called contact developing system in which a nonmagnetic one-component developer is used as a toner and a developing roller functioning as a developer carrier is brought into contact with a photoreceptor functioning as a latent image carrier to perform development. In this developing system, a plate-like blade is caused to abut on the surface of the developing roller to thereby adjust the thickness of the toner passing through the abutting portion of the blade and carried on the surface of the developing roller, that is, to adjust the toner adhesion amount. Examples of the blade that is generally used in a contact developing system include a bent blade that is bent at a predetermined angle to have a bent line that is parallel to a flat plate or the axis line of the developing roller.

As a method for causing such blade to abut on the developing roller, there is a so-called edge abutment method for causing a tip end of the blade to abut on the developing roller, and a so-called flat abutment method for bringing the blade into contact at its flat surface so as to have a length protruding to the developing roller.

The toner carried on the developing roller is transported to the abutting portion between the developing roller and the blade by friction between the developing roller and the supply roller supplying the toner to the developing roller. When an edge portion of the blade is caused to abut on the developing roller by means of the flat blade, the amount of toner that passes through the abutting portion between the developing roller and the blade and then is held on the developing roller fluctuates significantly by a small setting error generated in the conditions for causing the blade to abut on the developing roller. The reason is that when the edge of the blade is caused to abut on the developing roller by pressure larger than appropriate pressure, the edge of the blade scrapes off the developer; a slight change of pressure prevents the toner from passing through the abutting portion. Furthermore, when the developing roller is bent by the force of the blade pressing the developing roller, and thereby the width of the nip at the contact portion between the developing roller and the blade is changed, the amount of toner in the longitudinal direction of the developing roller also fluctuates.

When the flat blade or bent blade is caused to flat-abut against the developing roller, the amount of toner on the developing roller is stabilized by the effect of a toner pool obtained in front of the abutting portion, i.e., on the upstream side of the developing roller rotational direction of the abutting portion. However, at the toner pool a difference in the speed of movement is generated between the toner on the developing roller side and the toner on the blade side, whereby friction occurs between the toners, and as a result frictional heat is generated. The frictional heat caused by the frictions between the toners increases the toner temperature, thus so-called blade fusion occurs, in which the wax within the toner leaks up out of the surface and then adheres to the blade. As a result, the partial toner that is fused to the blade is blocked by the blade, causing image noise, which is so-called white stripe in which a part of an image is not formed. Such a phenomenon in which the toner is fused to the blade occurs more significantly when using a low-temperature fixable toner for the purpose of achieving energy saving, size reduction, high speed, and full-color images.

Moreover, peak pressure of the abutting portion becomes effective when the blade abutting against the developing roller regulates the toner. Since the surface layer of the developing blade abutting against the photoreceptor is elastic, in the case of the blade whose flat surface abuts against the developing roller, the surface layer of the developing roller deforms more significantly as the force of the blade pressing the developing roller becomes large, whereby the area of the abutting portion increases and the pressure is dispersed. Therefore, large pressing force is required in order to secure the peak pressure, but it might increase the torque for rotating the developing roller.

As a configuration for solving the problems caused in edge abutting and flat abutting, there is a configuration in which a plate-like blade is bent outward so that the outside thereof forms a curvature radius R, and then the outside of the bent portion is brought into contact with the developing roller. By causing the curved surface of the bent portion to abut against developing roller, the amount of toner passing through the abutting portion is prevented from being changed as drastic as when edge abutment is performed, because of an attachment error. For this reason, fluctuation of the amount of toner of the abutting portion is not as significant as when edge abutment is performed, thus stabilized toner transportation can be realized.

Furthermore, the amount of toner accumulated on the upstream side of the developing roller rotational direction of the abutting portion is small compared to when flat abutment is performed, thus the frictional heat that is generated by the friction of the toners can be suppressed. Therefore, the toner can be prevented from being fused to the blade, even when the low-temperature fixable toner is used. Moreover, since the blade is in contact with the developing roller surface at the curved surface of the blade, the peak pressure can be secured at a section that abuts against the developing roller surface at the deepest position, thus necessary peak pressure can be secured by means of less pressing force, compared to when flat abutment is performed. Accordingly, the torque for rotating the developing roller can be prevented from being increased.

However, the outer peripheral surface of the bent portion is stretched by bending the metallic plate material, causing surface roughening, i.e., cracking, on the surface of the bent portion. The generated crack blocks the flow of the toner, whereby the toner adheres to the cracks and is then fixed temporarily. Consequently, the amount of toner passing through the regulating portion fluctuates, and stripe-like image noise is generated on the image corresponding to the section where the toner is fixed to the blade. In order to remove the cracks from the bent portion, generally there are methods for performing buffing or other mechanical polishing, chemical polishing, electrolytic polishing and the like to obtain a smooth surface, but any of the methods require facilities and processing time, which results in a significant increase in the production cost.

Next is described the layer-thinning blade 12 functioning as a developer regulating member, which is a characteristic part of the present invention.

FIG. 3 shows the layer-thinning blade 12. The layer-thinning blade 12 is obtained by using a metallic plate spring material made of SUS304CSP, SUS301CSP, phosphor bronze or the like and then causing a free end side thereof to abut against the surface of the developing roller 11 by means of a pressing force where the linear pressure is 10 through 100 [N/m]. The layer-thinning blade 12 forms a thin layer of toner passing through the abutting portion between the layer-thinning blade 12 and the developing roller 11, the abutting portion being applied with the pressing force or less force, and charges the toner by friction.

Furthermore, the layer-thinning blade 12 is applied with a regulating bias that is offset in the same direction as that of the electrified polarity of the toner with respect to the developing bias, in order to assist with frictional charging.

As shown in FIG. 2, the photoreceptor 2 rotates in the clockwise direction, while the developing roller 11 rotates in the counterclockwise direction, thus the surface of the developing roller 11 moves in the same direction as the direction of surface movement of the photoreceptor 2 at a developing portion facing the photoreceptor 2.

The toner that is subjected to layer-thinning by the layer-thinning blade 12 is conveyed to the developing portion. Then, the toner is moved to and developed on the surface of the photoreceptor 2 in accordance with the developing bias applied to the developing roller 11 and a latent image electric field formed by the electrostatic latent image on the photoreceptor 2. At a section within where the toner that is not developed by the photoreceptor 2 at the developing portion and thus remains on the developing roller 11 is sent back into the toner supply chamber 7, a seal 13 is provided abutting against the developing roller 11 so that the toner does not leak to the outside of the developing device 5.

As shown in FIG. 3, the layer-thinning blade 12 of the present embodiment has an elastic plate-like member 12*a* made of a metallic material, wherein the plate-like member 12*a* has a bent portion 12*b* that is bent at a predetermined curvature radius R. An edge line of the bent portion 12*b* extends from the near side perpendicular to a paper surface in FIG. 1 to the far side, and the bent portion 12*b* abuts against the surface of the developing roller 11 so that this edge line intersects at right angles with a direction of surface movement of the developing roller 11.

As a result of a keen experiment carried out by the inventors of the present invention, it was found that when cracks are generated by bending the metallic plate member and thereby stretching the outer peripheral side of the bent portion, the surface roughness of the outer peripheral curved surface of the bent portion changes according to the average crystal particle diameter of the metallic plate member. Specifically, even if a plate member having the same thickness is bent at the same curvature radius, if the bent portion of this plate member is made of a material having a small average crystal particle diameter, the surface roughness (ten-point average roughness Rz) of outer peripheral curved surface of the bent portion is small, whereby it becomes difficult for the toner to be fixed to the layer-thinning blade 12.

A crack is generated at a boundary surface at which the metallic plate-like member 12*a* is bent. At this moment, if the average crystal particle diameter D is small, the size of the crack is small. The smaller the curvature radius R of the bent portion 12*b*, the larger the amount of deformation of the outer periphery of the bent portion 12*b*, thus the crack extends deeper, causing surface roughness. Moreover, if the crystal particle diameter is small a lot of small cracks are generated when the plate member is bent at the same curvature radius, while if the crystal particle diameter is large individual cracks become large easily. If the cracks are large, the developer gets stuck therein easily and is then fixed to the cracks.

In the layer-thinning blade 12 of the present embodiment, when the average crystal particle diameter of the plate-like member 12*a* is represented as D [μm] on the basis of the result of Experiment 1 described hereinafter, the layer-thinning blade 12 is configured such that the curvature radius R [μm] and the average crystal particle diameter D [μm] satisfy the following mathematical expression (1).

$$D \leqq 60.53 \times R \times 10^{-3} 12.61 \quad \text{Eq. (1)}$$

Experiment 1

In Experiment 1, layer-thinning blades 12 that have the plate-like members 12*a* having different curvature radiuses R [μm] at the respective bent portions 12*b* and different average crystal particle diameters D [μm] are used to perform a printing test to evaluate whether each of the layer-thinning blades 12 is suitable to be used as the developer regulating member.

As metallic materials having different average crystal particle diameters D, stainless steel flat plates made of SUS301 material, SUS304 material and NAR 301(a trademark of Sumitomo Metal Industries of Japan) material respectively and having a thickness of t=100 [μm] are prepared. Each of the prepared stainless steel materials was cut. The cut stainless steel material was subjected to nitric acid processing using ferric chloride solution. Thus obtained substance was observed using an electron microscope, and then the average particle diameter of the metallic crystal on the cut surface was measured. This crystal particle diameter is a value calculated from grain size number (grain size) according to JIS G 0551 or JIS G 0552.

FIG. 4 shows the metallic crystal average particle diameter of the cut surface of each plate-like member made of each metallic material.

The layer-thinning blade 12 that has the plate-like member 12*a* having different curvatures at the respective bent portions 12*b* was created for each of the metallic material (Experimental examples 1 through 14), and the curvature radius R and surface roughness of the outer peripheral curved surface of each of the bent portions 12*b* were measured using a surface roughness/contour shape measuring machine (produced by Tokyo Seimitsu Co., Ltd., SURFCOM200DX). At the same time, surface roughness of the flat part of each plate-like member 12*a* made of each metallic material was also measured.

FIG. 5 shows the material names, metallic average particle diameters D, curvature radiuses R, and ten-point average roughness Rz as the surface roughness of Experimental examples 1 through 14, the metallic materials and the curvature radiuses R [μm] of the bent portions being different according to these embodiments.

Experimental examples 15 through 17 shown in FIG. 5 are the results obtained by measuring the surface roughness of the flat parts of the respective plate-like member 12*a* made of the metallic materials.

Figure 6:
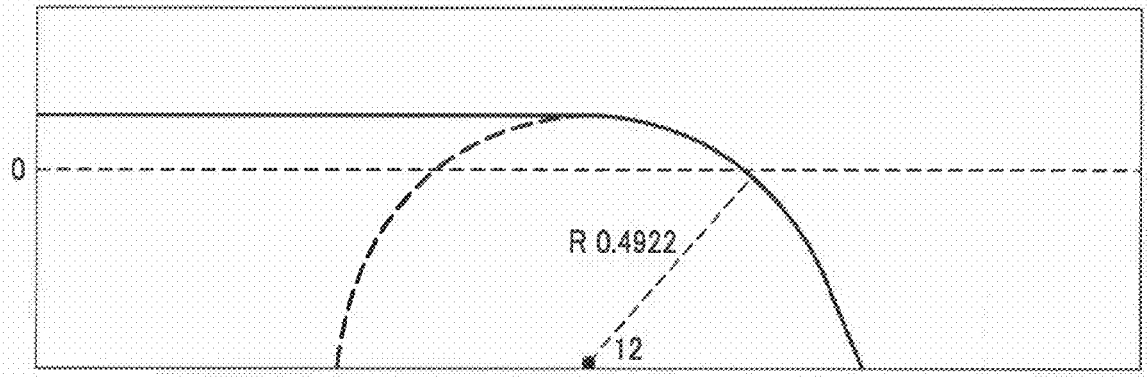
FIG. 6 is a view showing the results of detection of the shape and curvature radius R of the layer-thinning blade, the detection being performed in Experiment example 4.

FIG. 6 is a view showing the results of detection the shape and curvature radius R of the layer-thinning blade of Experimental example 4, which were obtained by measuring the bent portion of this layer-thinning blade using the surface roughness/contour shape measuring machine.

Figure 7:
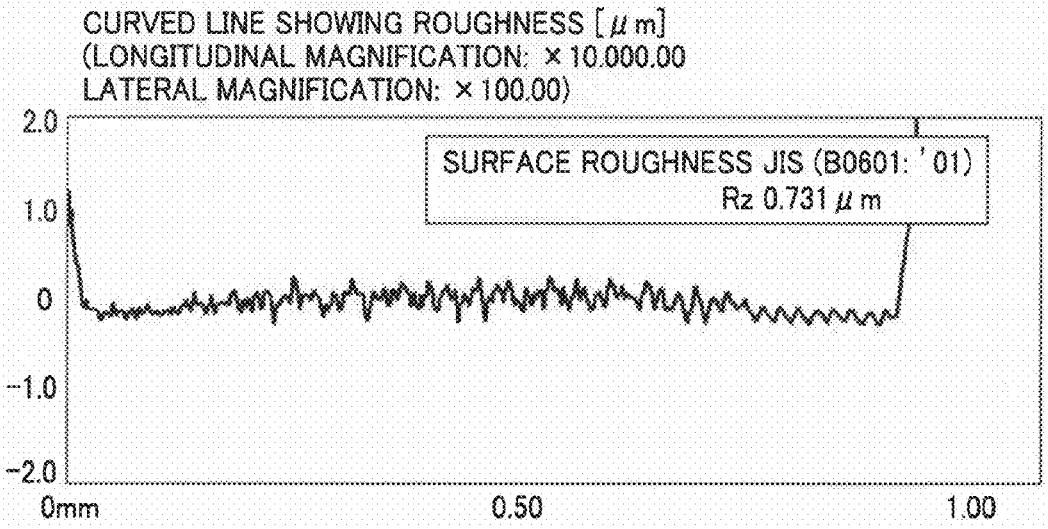
FIG. 7 is a view showing the results of calculation of surface roughness shape and ten-point surface roughness Rz of the layer-thinning blade, the calculation being performed in Experiment example 4.

FIG. 7 is a view showing the results of surface roughness shape and computation of the ten-point roughness Rz (JIS (B0601: '01)) of the layer-thinning blade 12 of Experimental example 4, which were obtained by measuring the bent portion of this layer-thinning blade using the surface roughness/contour shape measuring machine. The horizontal axis shown in FIG. 7 represents the length that is obtained when measuring the surface roughness (shape) of the bent portion, while the vertical axis represents the height of the indented surface.

Figure 8:
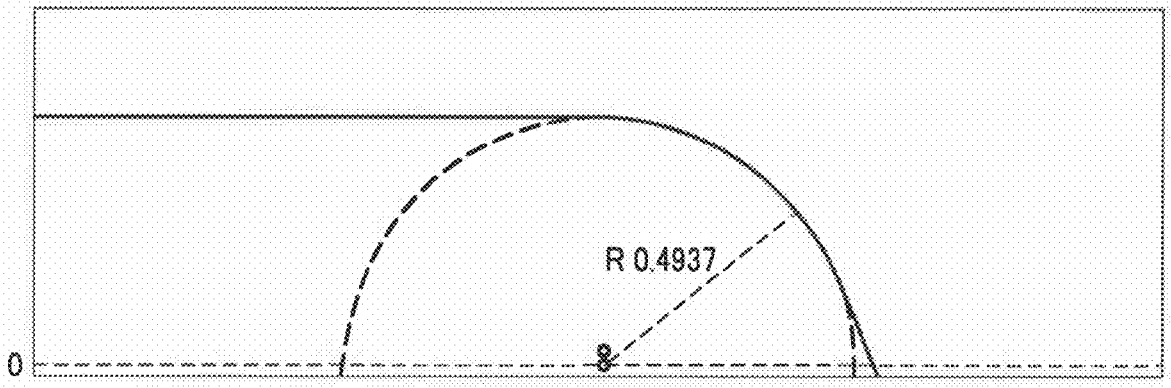
FIG. 8 is a view showing the results of detection of the shape and the curvature radius R of the layer-thinning blade, the detection being performed in Experiment example 7.

FIG. 8 is a view showing the results of detection of the shape and curvature radius R of the layer-thinning blade 12 of Experimental example 17, which were obtained by measuring the bent portion of this layer-thinning blade using the surface roughness/contour shape measuring machine.

Figure 9:
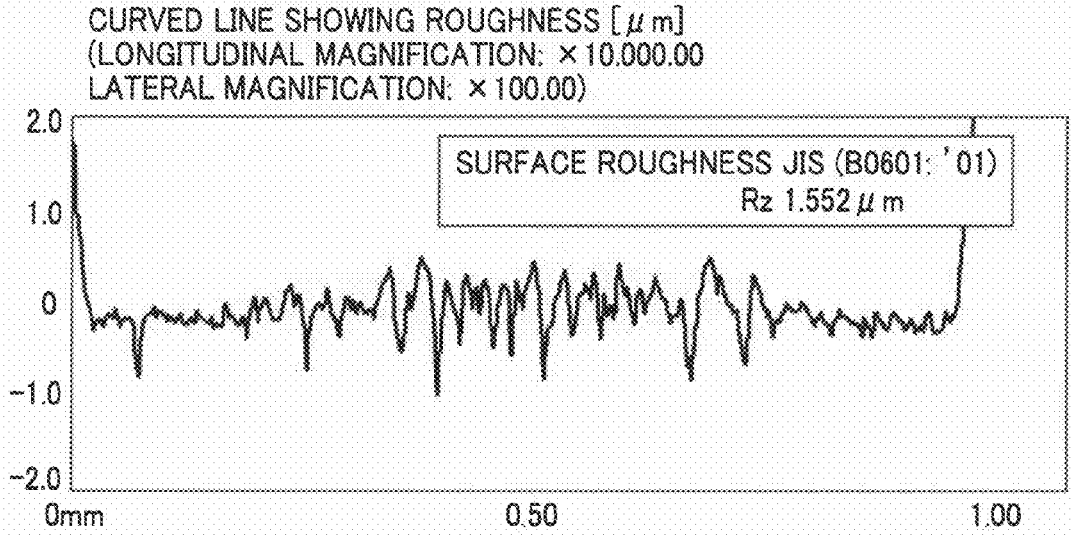
FIG. 9 is a view showing the results of calculation of the surface roughness shape and the ten-point surface roughness Rz of the layer-thinning blade, the calculation being performed in Experiment example 7.

FIG. 9 is a view showing the results of surface roughness shape and computation of the ten-point roughness Rz (JIS (B0601: '01)) of the layer-thinning blade 12 of Experimental example 7, which were obtained by measuring the bent portion of this layer-thinning blade using the surface roughness/contour shape measuring machine. The horizontal axis shown in FIG. 9 represents the length is obtained when measuring the surface roughness (shape) of the bent portion, while the vertical axis represents the height of the indented surface.

As shown in FIGS. 6 through 9, it is clear that even if the curvature radiuses R of these bent portions are the same, the surface roughness of the bent portions change due to the difference in the average crystal particle diameters of the metallic plate-like members.

Next, an experiment was performed in which the layer-thinning blades 12 of Experimental examples 1 through 14 shown in FIG. 5 were incorporated in the developing device 5 shown in FIG. 2 and a printing test was performed using five thousand papers in a high-temperature/high-humidity environment of 30 [° C.]/80 [% RH] and a low-temperature/low-humidity environment of 10 [° C.]/15 [%]. Then, fixation of the toner to each blade and stability of toner amount were evaluated. Then, on the basis of the evaluation of blade fixation and evaluation of stability of toner amount, a comprehensive evaluation was performed to evaluate whether the layer-thinning blade 12 of each embodiment is suitable to be used for image formation.

It should be noted that in the developing device 5 used in Experiment 1 the layer-thinning blade 12 is caused to abut against the surface of the developing roller 11 by means of a pressing force where the linear pressure is 50 [N/m].

Furthermore, the external diameter of the developing roller 11 of the developing device 5 is 12 [mm]. The MD-1 hardness of the developing roller 11 is 42 [°] and, for the surface roughness, arithmetic average roughness Ra is 1.2 [μm].

Moreover, as the nonmagnetic one-component developer, a developer having a binder resin, a colorant, and wax and having an average circularity degree of 0.95 is used.

FIG. 10 shows the experimental results of Experiment 1.

In FIG. 10, for the fixation of the toner to the blade, the bent portion of the layer-thinning blade 12 was observed after a printing test was performed using five thousand papers, and if it was confirmed that the toner was fixed to the blade, the result was evaluated as "x", but if it was confirmed that the toner was not fixed, the result was evaluated as "○".

For stability of the toner amount, it was determined whether the amount of toner remaining on the surface of the developing roller 11 after passing through the abutting portion was within an appropriate range or not under conditions in which the amount of toner passing through the abutting portion increases (lower limit of a regulating pressing force set value, upper limit of a regulating blade abutment set value (protruding direction), low-temperature/low-humidity environment condition, after enduring an endurance condition), and conditions in which the amount of toner decreases (upper limit of the regulating pressing force set value, lower limit of the regulating blade abutment set value (edge abutment direction), high-temperature/high-humidity environment condition, initial stage of the endurance condition). As the method of determination, if the amount of toner remaining on the surface of the developing roller 11 after passing through the abutting portion was less than 4.3 [μg/m$^2$], the result was evaluated as "x", if the amount of toner was 4.3 [μg/m$^2$] or more but less than 7.0 [μg/m$^2$], the result was evaluated as "○", if the amount of toner was 7.0 [μg/m$^2$] or more but less than 8.0 [μg/m$^2$], the result was evaluated as "Δ", and if the amount of toner was 8.0 [μg/m$^2$] or more, the result was evaluated as "x".

Here, "regulating pressing force set value" is the pressure obtained when the metallic regulating blade made of a thin plate is deflected and caused to abut against the developing roller, and the lower limit of this pressure is obtained in a combination of the case where the amount of deflection of the blade becomes small at the regulating blade mounting tolerance, and the case where the thickness of the thin plate material used in the regulating blade becomes small at the thin plate material thickness tolerance. On the other hand, the upper limit of this pressure is obtained in a combination of the case where the amount of deflection becomes large at the regulating blade mounting tolerance, and the case where the thickness of the thin plate material used in the regulating blade becomes large at the thin plate material thickness tolerance.

Furthermore, "regulating blade abutment set value" indicates the position where the bent portion of the regulating blade abuts against the developing roller, and the lower limit of this value (edge abutment direction) indicates the position where the bent portion abuts on the furthest downstream side in the direction of rotation of the developing roller at the regulating blade mounting tolerance. On the other hand, the upper limit of this value (protruding direction) indicates the position where the bent portion abuts on the furthest upstream side in the direction of rotation of the developing roller at the regulating blade mounting tolerance.

Moreover, as a comprehensive evaluation, if either one of the results of the evaluation of the blade fixation or toner amount stability was "x", the result was evaluated as "x", and if the result of the evaluation of blade fixation is "○" and the result of the evaluation of toner amount stability was "○" or "Δ", then the result was evaluated as "○".

Figure 11:
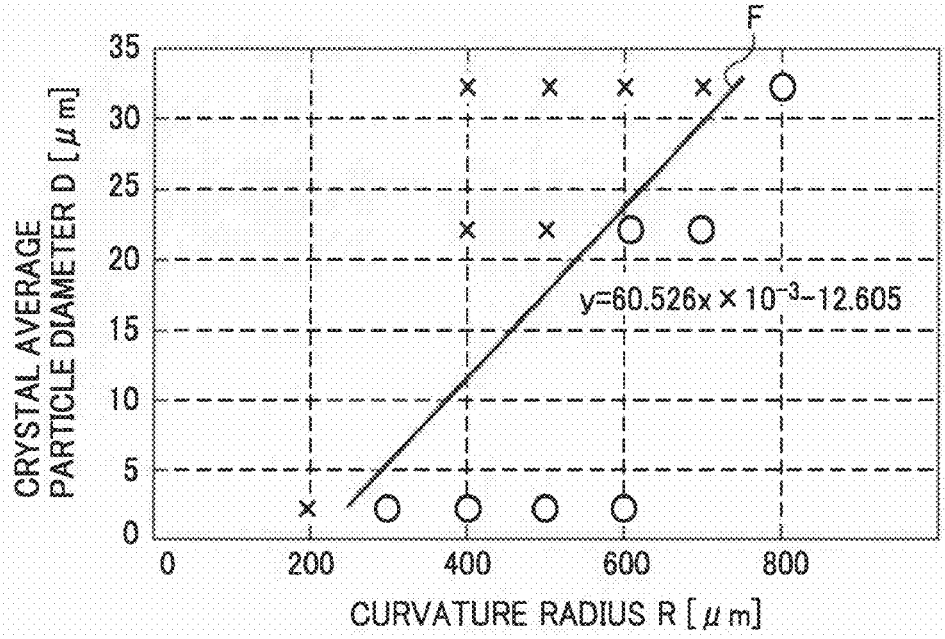
FIG. 11 is a graph showing the relationship between the curvature radius R and a crystal average particle diameter D of the layer-thinning blade of Experimental examples 1 through 14.

FIG. 11 is a graph showing the relationship between the curvature radius R and the crystal average particle diameter D of each of the layer-thinning blades 12 of Experimental examples 1 through 14 shown in FIG. 10. For the embodiments where the results of the comprehensive evaluation are "○", "○" is plotted, and for the embodiments where the results of the comprehensive evaluation are "x", "x" is plotted. In FIG. 11, the horizontal axis indicates the curvature radius R [μm] and the vertical axis indicates the crystal particle diameter D [μm].

As shown in FIG. 11, the plotted "○" and the plotted "x" can be divided at a straight line F shown in FIG. 11. In the straight line F shown in FIG. 11, $y=60.526x\times10^{-3}-12.605$, and it is clear that the result of the comprehensive evaluation is "x" when the average crystal particle diameter D is larger than $60.526R\times10^{-3}-12.605$ of the curvature radius R.

Therefore, the layer-thinning blade 12 of the present embodiment is configured such that, when the average crystal particle diameter of the plate-like member 12*a* is the average crystal particle diameter D [μm], the curvature radius R [μm] and the average crystal particle diameter D [μm] satisfy the abovementioned mathematical expression (1).

According to Experiment 1, it was found that, if the average crystal particle diameter D [μm] of the plate-like member 12*a* and the curvature radius R [μm] satisfy the relationship of $D\leqq60.53\times R\times10^{-3}-12.61$, the toner as the developer can be prevented from being fixed to the layer-thinning blade 12, which is the developer regulating member, even if the blade is used over time. Moreover, in this configuration, the relationship between the average crystal particle diameter D and the curvature radius R is set so that the toner is prevented from being fixed to the layer-thinning blade 12 by cracks, thus a step of removing the cracks from the bent portion 12*b* is not required to be made during the production of the layer-thinning blade 12. Since the step of removing the cracks from the bent portion 12*b* of the plate-like member 12*a* is not required, an increase in the production cost can be prevented and the toner can be prevented from being fixed to the layer-thinning blade 12, thus the amount of toner on the developing roller can be stably regulated even if the blade is used over time.

Figure 12:
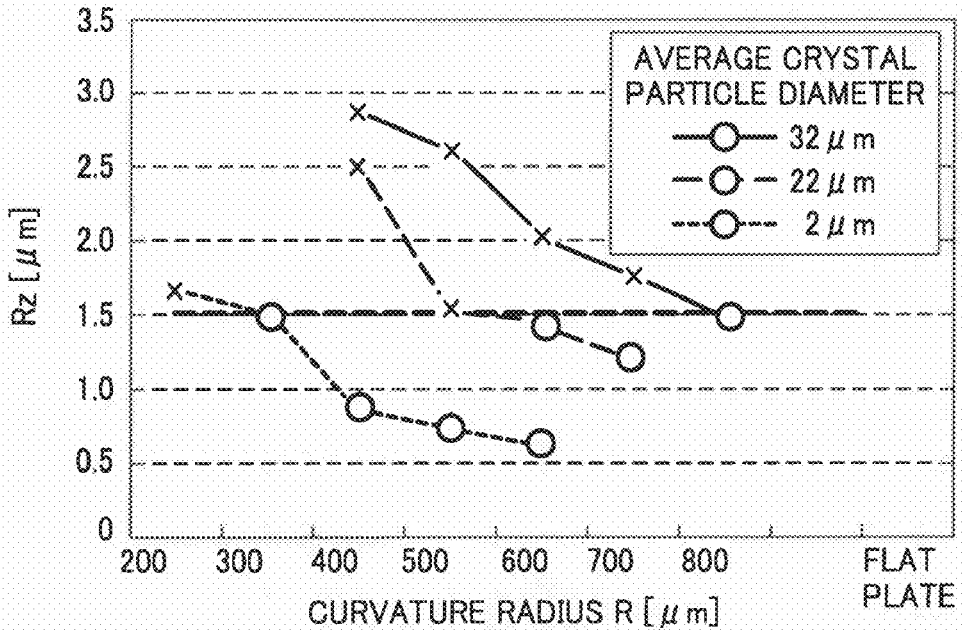
FIG. 12 is a graph showing the relationship between the curvature radius R and the surface roughness Rz of the bent portion of the layer-thinning blade for each metallic material.

FIG. 12 is a graph showing the relationship between the curvature radius R and surface roughness Rz of the bent portion 12*b* of each of the layer-thinning blades 12 having different average crystal particle diameters and made of the respective metallic materials in Experimental examples 1 through 14. For the embodiments where the results of the comprehensive evaluation are "○," "○" is plotted, and for the embodiments where the results of the comprehensive evaluation are "x," "x", is plotted. In FIG. 12, the horizontal axis indicates the curvature radius R [μm] and the vertical axis indicates the surface roughness (ten-point average roughness Rz) [μm].

As shown in FIG. 12, even when using a layer-thinning blade 12 made of any metallic material, as long as the ten-point average roughness Rz is 1.5 [μm] or lower, the result of comprehensive evaluation is "○", which clearly means that the layer-thinning blade 12 is suitable to be used for image formation. Therefore, the surface roughness of the outer peripheral curved surface of the bent portion 12*b* of the plate-like member 12*a* of the layer-thinning blade 12 has a ten-point average roughness Rz of between 0 [μm] and 1.5 [μm].

Experiment 2

It should be noted that even if the average crystal particle diameter D [μm] of the plate-like member 12*a* and the curvature radius R [μm] satisfy the relationship of $D\leqq60.53\times R\times10^{-3}-12.61$, the surface roughness of the outer peripheral curved surface of the bent portion 12*b* sometimes exceeds a ten-point average roughness Rz of 1.5 [μm], depending on the processing method for bending the plate-like member 12*a*.

The roughness of the bent surface is small when bending the plate-like member 12*a* using a brake bending method (processing method of bending slowly), and the roughness of the bent surface is large when bending the plate-like member 12*a* using a press bending method (processing method of bending quickly). Experimental examples 2 through 14 shown in FIG. 5 and FIG. 10 are the layer-thinning blades 12 bent by using a servo-press method (bending slowly at the moment of bending, and thereafter moving quickly). Here, layer-thinning blades 12 each of which has the plate-like member 12*a* bent by the regular press bending method (bending quickly) were prepared (Experimental examples 18, 19).

Moreover, the plate-like member 12*a* of each layer-thinning blade 12 is in the form of an elastic metallic thin plate, i.e., in the form of a metallic plate spring. By using an elastic metallic thin plate, pressing force acts on the abutting portion between the developing roller 11 and the blade when the plate-like member 12*a* is disposed in a deflecting manner, whereby the blade can be caused to abut against the developing roller at a predetermined linear pressure.

For the plate thickness t of the plate-like member 12*a* of the layer-thinning blade 12, if the plate thickness t is small, a pressing force smaller than that for large plate thickness t acts even if the layer-thinning blade 12 is deflected by the same amount. When the plate-like member 12*a* having small plate thickness t is used, it is necessary to deflect the plate-like member 12*a* significantly in order to secure a desired pressing force. In a configuration where the plate-like member 12*a* is deflected significantly, a large installation space is required, which increases the size of the developing device 5, thus it is preferred that the plate thickness t of the plate-like member 12*a* be substantially 60 [μm] or more.

If, on the other hand, the plate thickness t is large, a large crack is formed even if the outer peripheral surface is bent to have the same curvature radius R, whereby the value of the ten-point average roughness Rz of the surface roughness also increases. Therefore, there were prepared layer-thinning blades 12, each of which has the plate-like member 12*a* having a plate thickness t larger than that of the plate-like member 12*a* used in Experiment 1 (Experimental examples 20, 21). It should be noted that the plate thickness t of the plate-like member 12*a* of Experimental example 20 is 120 [μm] and the plate thickness t of the plate-like member 12*a* of Experimental example 21 is 150 [μm].

Moreover, if the curvature radius R of the bent portion 12*b* of each of the plate-like members 12*a* is too small, the amount of change in the outer peripheral surface of the bent portion 12*b* increase, whereby the bending stress increases, causing a large crack easily.

If, on the other hand, the curvature radius R of the bent portion 12*b* of the plate-like member 12*a* is too large, the plate-like member 12*a* becomes almost flat, whereby the abutting section between the developing roller 11 and the plate-like member is configured such that they flat-abut against each other at the flat part of the plate-like member. Therefore, if the curvature radius R is too large, the pressing force for securing the peak pressure required for regulating the amount of toner on the developing roller 11 increases as with the case of flat abutment. If the pressing force from the layer-thinning blade 12 increases, the torque for rotating the developing roller 11 increases, whereby mechanical strength is required. Therefore, there was prepared a layer-thinning blade 12, which has the plate-like member 12*a* having a curvature radius R (R=1000 [μm]) larger than that used in Experiment 1 (Experimental example 22).

If the bending angle θ on the inside of the bent portion 12*b* of the plate-like member 12*a* is too small, the amount of change in the outer peripheral surface of the bent portion 12*b* increases, whereby the bending stress increases, causing a large crack easily.

If, on the other hand, the bending angle θ on the inside of the bent portion 12*b* of the plate-like member 12*a* is too large, the plate-like member 12*a* becomes almost flat, whereby the abutting section between the developing roller 11 and the plate-like member is configured such that they flat-abut against each other at the flat part of the plate-like member. Therefore, if the bending angle θ is too large, the pressing force for securing the peak pressure required for regulating the amount of toner on the developing roller 11 increases as with the case of flat abutment. If the pressing force from the layer-thinning blade 12 increases, the torque for rotating the developing roller 11 increases, whereby mechanical strength is required. Therefore, there were prepared layer-thinning blades 12 that have the plate-like member 12*a* having different bending angles θ by bending the plate-like members 12*a* having a metallic average particle diameter of 2 [μm] so as to have a radius curvature of 500 [μm] (Experimental examples 23, 24, 25 and 26). It should be noted that the bending angle θ is 75 [°] in Experimental example 23, 105 [°] in Experimental example 24, 120 [°] in Experimental example 25, and 135 [°] in Experimental example 26.

In Experiment 2, Experimental examples 18 through 26 were used to perform the same experiment as Experiment 1 to evaluate whether each of the layer-thinning blades 12 is suitable to be used as the developer regulating member.

FIG. 13 shows the material names, metallic average particle diameters D, curvature radiuses R, and ten-point average roughness Rz as the surface roughness of the plate-like members 12*a* used in Experiment 2. It should be noted that FIG. 13 also shows Experimental example 2 and Experimental example 8 having the material names, metallic average particle diameters D and radius curvatures R that are same as those of Experimental example 18 and Experimental example 19, in order to compare them with Experimental example 18 and Experimental example 19.

FIG. 14 shows the results of Experiment 2. It should be noted that FIG. 14 also shows the results of Experiment 1 that are obtained for Experimental example 2 and Experimental example 8.

If the ten-point average roughness Rz as the surface roughness of the outer peripheral curved surface of the bent portion 12*b* exceeds 1.5 [μm] as compared to Experimental examples 18 and 19, it was found that there is a risk that the toner might be fixed to this blade when using this blade for image formation.

Moreover, if the plate thickness t is 150 [μm] or more as compared to Experimental example 20 (plate thickness t=120 [μm]) and Experimental example 21 (plate thickness t=150 [μm]), it was found that there is a risk that the toner might be fixed to this blade when using this blade for image formation. Therefore, if the one having a plate thickness t of at least 60 [μm] but less than 150 [μm] is used as the plate-like member 12*a*, an increase in the size of the developing device 5 can be prevented, and at the same time blade fixation can be prevented from occurring. Note that, as shown in FIG. 14, the ten-point average roughness Rz of Experimental example 20 in which the result of the comprehensive evaluation is "○" is 1.12 [μm], which is within the range of equal to or less than 1.5 [μm], and the ten-point average roughness Rz of the bent portion 12*b* of Experimental example 21 in which the result of the comprehensive evaluation is "x" is 2.01 [μm], which exceeds 1.5 [μm].

If the curvature radius R of the bent portion 12*b* of the plate-like member 12*a* is small, it is difficult to satisfy the abovementioned Eq. (1). According to Experimental example 1 of Experiment 1, it was found that if the curvature radius R is below 200 [μm] there is a risk that the toner might be fixed to this blade when using this blade for image formation.

Moreover, according to Experimental example 22, if the curvature radius R is 1000 [μm], blade fixation does not occur, but even if the pressing force of the layer-thinning blade 12 against the developing roller 11 is 100 [N/m], the amount of toner on the developing roller 11 does not reach the appropriate value, whereby the result of evaluation of stability of the toner amount is "x". When attempting to set the toner amount to the appropriate value in such a configuration, the pressing force of the layer-thinning blade 12 against the developing roller 11 exceeds 100 [N/m]. If the pressing force is large, the torque for rotating the developing roller 11 becomes large, requiring a large motor as a driving source for rotating the developing roller 11 and increasing the size of the device. In addition, mechanical strength is required for the developing roller 11 and for a driving system thereof so as to be able to stably rotate the developing roller 11 even when a large pressing force is applied, hence this configuration is not practical because it might increase the production cost.

According to Experimental example 1 and Experimental example 22 of Experiment 1, blade fixation can be prevented from occurring and at the same time the torque for rotating the developing roller 11 can be prevented from being increased, by setting the curvature radius R of the bent portion 12*b* of the plate-like member 12*a* within the range of 200 [μm] or more and less than 1000 [μm].

Furthermore, if the bending angle θ is 75 [°] as compared to Experimental example 23 (θ=75 [°]), Experimental example 24 (θ=105 [°]), Experimental example 25 (θ=120 [°]), and Experimental example 26 (θ=135 [°]), it was found that there is a risk that the toner might be fixed to this blade when this blade is used for image formation. If the bending angle θ is 135 [°], blade fixation does not occur, but even if the pressing force of the layer-thinning blade 12 against the developing roller 11 is 100 [N/m], the amount of toner on the developing roller 11 does not reach the appropriate value, whereby the result of evaluation of stability of the toner amount is "x". Therefore, as with Experimental example 22, setting the bending angle θ to 135 [°] is not practical.

According to Experimental examples 23 through 26, by setting the angle θ on the inside of the bent portion 12*b* of the plate-like member 12*a* within the range of 80 [°] or more and less than 135 [°], blade fixation can be prevented from occurring and the torque for rotating the developing roller 11 can be prevented from being increased. Note that, as shown in FIG. 14, the ten-point average roughness Rz of Experimental example 24 in which the result of the comprehensive evaluation is "○" is 0.67 [μm], which is within the range of equal to or less than 1.5 [μm], and the ten-point average roughness Rz of the bent portion 12*b* of Experimental example 23 in which the result of the comprehensive evaluation is "x" is 1.51 [μm], which exceeds 1.5 [μm].

Experiment 3

If the linear pressure of the abutting portion where the layer-thinning blade 12 abuts against the developing roller 11 is too low, the peak pressure cannot be secured and the amount of toner on the developer roller 11 that is to be transported cannot be regulated sufficiently. If the amount of toner to be transported cannot be regulated sufficiently, surface stain and the like occur to deteriorate the image quality.

Therefore, in Experiment 3, a plurality of layer-thinning blades 12 having different curvature radiuses R were prepared, and the pressing force (linear pressure) of each of the layer-thinning blades 12 against the developing roller 11 was changed to detect the amount of toner on the developing roller 11.

Figure 15:
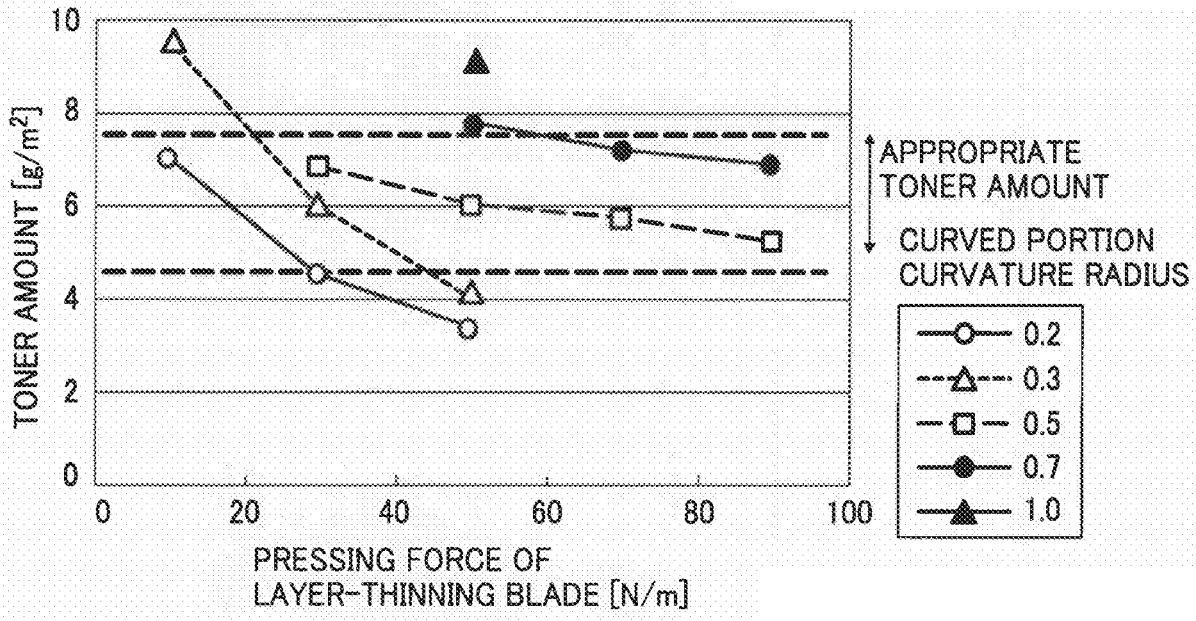
FIG. 15 if a graph showing the experimental results of Experiment 3 of the present embodiment.

FIG. 15 is a graph showing the results of Experiment 3. It should be noted that each of the layer-thinning blades 12 used in Experiment 3 has a plate-like member 12*a* having a metallic average particle diameter of 2 [μm] and a plate thickness of 100 [μm]. As shown in FIG. 15, the pressing force, which is an appropriate amount of toner, varies according to the curvature radiuses R of the bent portions 12*b*, and thus is set to a pressing force matching the curvature radiuses R of the bent portions 12*b*, with the relationship shown in FIG. 15 in mind. By setting the pressing force such that the toner in an appropriate amount passes through the abutting portion, the occurrence of surface stain and the like that deteriorate the image quality can be prevented.

Experiment 4

On the other hand, if the pressing force on the abutting portion increases, the torque for rotating the developing roller 11 increases, requiring mechanical strength.

Here, in Experiment 4, the pressing force (linear pressure) of each layer-thinning blade 12 against the developing roller 11 was changed to detect the torque for driving the developing roller 11.

Figure 16:
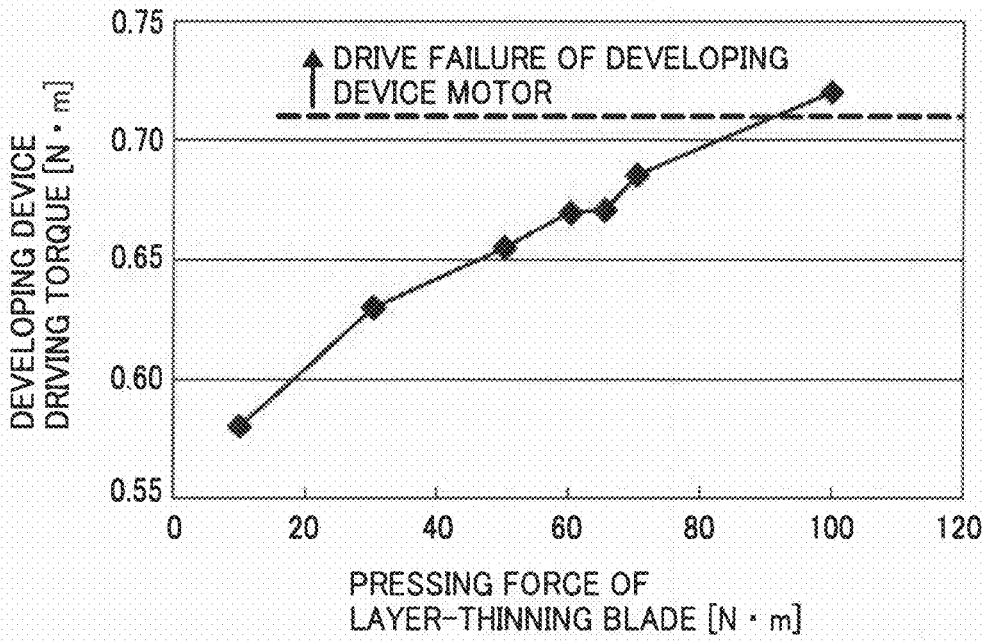
FIG. 16 is a graph showing the experimental results of Experiment 4 of the present embodiment.

FIG. 16 is a graph showing the results of Experiment 4. As shown in FIG. 16, when a developing device driving torque increases as the pressing force increases, and thereby the pressing force reaches 100 [N/m], drive of the motor of the developing device 5 failed. For this reason, in the developing device 5 of the present embodiment, the pressing force is set such that the linear pressure on the abutting portion between the layer-thinning blade 12 and the developing roller 11 becomes 100 [N/m] or less.

Experiment 5

The toner adhesiveness and stability of the toner amount vary according to the characteristics of the developing roller 11.

Here, in Experiment 5 the same experiment as Experiment 1 was performed in which the layer-thinning blade 12 of Experimental example 4 was caused to abut against a plurality of developing rollers 11 having a MD-1 hardness of 32 [°] or 55 [°] and an arithmetic average roughness Ra of 0.6 through 1.8 [μm], to evaluate whether the layer-thinning blade 12 is suitable to be used as the developer regulating member.

FIG. 7 shows the results of Experiment 5.

According to Experiment 5, the hardness of the developing rollers 11 is set to MD-1 hardness of between 30 [°] and 60 [°], and the arithmetic average roughness Ra of the surface roughness is set within the range of between 0.7 [μm] and 1.7 [μm], whereby the toner can be prevented from being fixed to the layer-thinning blade 12, thus the amount of toner on the developing rollers 11 can be stably regulated even if the blade is used over time. Furthermore, since the amount of toner can be stabilized, abutment nip width between the layer-thinning blade 12 and the developer roller 11 can be secured to charge the toner sufficiently, and a uniform toner layer can be supplied.

Furthermore, the external diameter of each developing roller 11 is 12 [mm]. If the external diameter of the developing roller 11 is too small, the amount of toner passing through the abutting portion on which the bent portion 12*b* with the curvature radius R cannot be regulated stably. On the other hand, if the external diameter of the developing roller 11 is too large, the size of the developing device 5 is increased. Accordingly, the external diameter of the developing roller 11 is preferably within the range of between 8 [mm] and 4 [mm].

Moreover, the toner used in the present embodiment has a binder resin, a colorant, and wax. A binder resin and a colorant are normally contained in a developer. Wax needs to be contained in a toner that is used in an image forming apparatus for performing oilless fixation. The reason is that if the toner does not contain wax, the paper having an image thereon is not separated from a fixing member. However, if wax is included, it becomes difficult for the toner to be fixed at the abutting portion between the layer-thinning blade 12 and the developing roller 11. On the other hand, by applying the layer-thinning blade 12 of the present embodiment, the occurrence of blade fixation can be prevented even if the toner having wax is used.

Moreover, it is preferred to use a toner having an average circularity degree of 0.950 or higher but 0.990 or lower, which represents substantially circular toner. By using substantially circular toner, it becomes difficult for the toner to be fixed to the layer-thinning blade 12 at the abutting portion between the layer-thinning blade 12 and the developing roller 11.

Moreover, in the case of producing the layer-thinning blade 12 of the present embodiment, when the bent portion 12*b* is formed by bending the metallic thin plate plate-like member 12*a* at a predetermined curvature radius R [μm], the metallic thin plate is bent such that the average crystal particle diameter D [μm] of the plate-like member 12*a* and the curvature radius R [μm] satisfy Eq. 1.

As described above, according to the present embodiment, if the layer-thinning blade 12 functioning as the developer regulating member is configured such that the average crystal particle diameter D [μm] of the plate-like member 12*a* and the curvature radius R [μm] of the bent portion 12*b* satisfy the relationship of $D \leqq 60.53 \times R \times 10^{-3} - 12.61$, the toner functioning as the developer can be prevented from being fixed to the layer-thinning blade 12 functioning as the developer regulating member, even if the blade is used over time. In addition, according to this configuration, the relationship between the average crystal particle diameter D and the curvature radius R is set in order to prevent the toner from being fixed to the layer-thinning blade 12 by cracks, thus a step of removing the cracks from the bent portion 12*b* is not required to be made during the production of the layer-thinning blade 12. Therefore, since the step of removing the cracks from the bent portion 12*b* of the plate-like member 12*a* is not required, an increase in the production cost can be prevented and the toner can be prevented from being fixed to the layer-thinning blade 12, thus the amount of toner on the developing roller can be stably regulated even if the blade is used over time.

Furthermore, by setting the surface roughness Rz of the bent portion 12*b* of the plate-like member 12*a* provided in the layer-thinning blade 12 to between 0 [μm] and 1.5 [μm], blade fixation of the toner can be prevented from occurring without blocking the flow of toner, thus a uniform toner layer can be formed.

By using the plate-like member 12*a* having a plate thickness t of at least 60 [μm] but less than 150 [μm], an increase in the size of the developing device 5 can be prevented, and the occurrence of blade fixation can also be prevented.

By setting the curvature radius R of the bent portion 12*b* of the plate-like member 12*a* within the range of at least 200 [μm] and less than 100 [μm], the occurrence of blade fixation and an increase in the torque for rotating the developing roller 11 can be prevented.

By setting the angle θ on the inside of the bent portion 12*b* of the plate-like member 12*a* within the range of at least 80 [°] and less than 135 [°], the occurrence of blade fixation and an increase in the torque for rotating the developing roller 11 can be prevented.

By applying the layer-thinning blade 12 as the developer regulating means of the developing device 5, the amount of toner on the developing roller can be stably regulated even if the blade is used over time.

By setting the hardness of the developing roller 11 functioning as the developer carrier to a MD-1 hardness of between 30 [°] and 60 [°] and by setting the arithmetic average roughness Ra of the surface roughness within the range of between 0.7 [μm] and 1.7 [μm], abutment nip width between the layer-thinning blade 12 and the developer roller 11 can be secured to charge the toner sufficiently, and a uniform toner layer can be supplied.

By including wax in the toner, oilless fixation can be performed. Although the toner containing wax is easily fixed to the layer-thinning blade 12, the developing device 5 of the present embodiment can prevent the occurrence of blade fixation even if the toner containing wax is used.

By forming the process unit 1 as a process cartridge that integrally has the photoreceptor 2, photoreceptor cleaning 3, destaticizing device (not shown), charging roller 4, developing device 5 and the like, wear-out parts can be replaced at once so that maintenance can be performed easily.

By providing the developing device 5, which is the developing means and has the layer-thinning blade 12, in the printer 100, which is the image forming apparatus, the amount of toner on the developing roller can be regulated stably even if the blade is used over time, thus stripe-like image noise, which is caused by the toner fixed to the developer regulating member, can be prevented from occurring, whereby the image quality can be maintained over time.

According to the method of producing the layer-thinning blade 12, the layer-thinning blade 12 capable of preventing the toner from being fixed can be produced by forming the bent portion 12*b* by bending the plate-like member 12*a* so that the average crystal particle diameter D [μm] of the plate-like member 12*a* and the curvature radius R [μm] of the bent portion 12*b* satisfy the relationship of $D \leqq 60.53 \times R \times 10^{-3} - 12.61$. Furthermore, since the step of removing the cracks from the bent portion 12*b* of the plate-like member 12*a* is not required, an increase in the production cost can be prevented.

The present invention can provide the excellent effects of preventing an increase in the production cost because the step of removing the cracks from the bent portion of the plate-like member is not required, and of preventing the developer from being fixed to the developer regulating member so that the developer can be regulated stably even if the blade is used over time.

Various modifications will become possible for those skilled in the art after receiving the teachings of the present disclosure, without departing from the scope thereof.

What is claimed is:

1. A developer regulating member, which comprises a plate-like member made of an elastic metallic material and having a bent portion bent at a predetermined curvature radius, and which causes a surface of the bent portion to abut against a surface of a developer carrier so that an edge line of the bent portion intersects at right angles with a direction of surface movement of the developer carrier, to thereby regulate the thickness of a developer on the developer carrier, wherein the plate thickness of the plate-like member is at least 60 [μm] but less than 150 [μm], and wherein when the curvature radius is represented as R [μm] and an average crystal particle diameter of the plate-like member is represented as D [μm], the curvature radius R and the average crystal particle diameter D satisfy the following expression (1):

$$D \leqq 60.53 \times R \times 10^{-3} - 12.61 \quad \text{Eq. (1).}$$

2. The developer regulating member as claimed in claim 1, wherein ten-point average surface roughness Rz of the surface of the bent portion is between 0 [μm] and 1.5 [μm].

3. The developer regulating member as claimed in claim 1, wherein the curvature radius R of the bent portion is at least 200 [μm] but less than 1000 [μm].

4. The developer regulating member as claimed in claim 1, wherein the angle of the bent portion is at least 80 [°] but less than 135 [°].

5. A developing device, comprising:

a developer carrier that supports and transports one-component developer; and a developer regulating member that regulates the developer on the developer carrier, wherein the developer regulating member comprises a plate-like member made of an elastic metallic material having a plate thickness of at least 60 [μm] but less than 150 [μm] and having a bent portion bent at a predetermined curvature radius, and causes a surface of the bent portion to abut against a surface of a developer carrier so that an edge line of the bent portion intersects at right angles with a direction of surface movement of the developer carrier, to thereby regulate the thickness of a developer on the developer carrier, and when the curvature radius is represented as R [μm] and an average crystal particle diameter of the plate-like member is represented as D [μm], the curvature radius R and the average crystal particle diameter D satisfy the following expression (1):

$$D \leqq 60.53 \times R \times 10^{-3} - 12.61 \quad \text{Eq. (1).}$$

6. The developing device as claimed in claim 5, wherein the developer carrier has a MD-1 hardness of between 30 [°] and 60 [°], and an arithmetic average roughness Ra of surface roughness within the range of between 0.7 [μm] and 1.7 [μm].

7. The developing device as claimed in claim 5, wherein the developer contains at least a binding resin, a colorant, and wax.

8. An image forming apparatus, comprising:

a latent image carrier; and developing means for developing a latent image formed on the latent image carrier by using a developer, the developing means having:

a developer carrier that supports and transports one-component developer; and a developer regulating member that regulates the developer on the developer carrier, wherein the developer regulating member comprises a plate-like member made of an elastic metallic material having a plate thickness of at least 60 [μm] but less than 150 [μm] and having a bent portion bent at a predetermined curvature radius, and causes a surface of the bent portion to abut against a surface of a developer carrier so that an edge line of the bent portion intersects at right angles with a direction of surface movement of the developer carrier, to thereby regulate the thickness of a developer on the developer carrier, and when the curvature radius is represented as R [μm] and an average crystal particle diameter of the plate-like member is represented as D [μm], the curvature radius R and the average crystal particle diameter D satisfy the following expression (1):

$$D \leqq 60.53 \times R \times 10^{-3} - 12.61 \quad \text{Eq. (1).}$$

* * * * *